US006381782B2

(12) United States Patent
Watanabe et al.

(10) Patent No.: US 6,381,782 B2
(45) Date of Patent: May 7, 2002

(54) BODY SUPPORTING TOOL FOR BED

(75) Inventors: Yasuo Watanabe; Toru Takahashi, both of Shinjuku-ku (JP)

(73) Assignee: Kabushiki Kaisha Nihon M.D.M. (JP)

( * ) Notice: Subject to any disclaimer, the term of this patent is extended or adjusted under 35 U.S.C. 154(b) by 0 days.

(21) Appl. No.: 09/814,517

(22) Filed: Mar. 22, 2001

(30) Foreign Application Priority Data

May 31, 2000 (JP) ..... 2000-163412

(51) Int. Cl.[7] ..... A61G 13/12
(52) U.S. Cl. ..... 5/621; 5/600; 5/630
(58) Field of Search ..... 5/621, 630, 632, 5/652, 657, 600; 248/286.1, 285.1

(56) References Cited

U.S. PATENT DOCUMENTS

| | | | | | |
|---|---|---|---|---|---|
| 721,587 | A | * | 2/1903 | Lyons | 5/621 |
| 998,996 | A | * | 7/1911 | Swenson et al. | 5/634 |
| 1,356,365 | A | * | 10/1920 | Hosmer | 5/621 X |
| 1,573,571 | A | * | 2/1926 | Pohl | 5/621 X |
| 1,731,709 | A | * | 10/1929 | Cropsey | 5/632 |
| 2,119,325 | A | * | 5/1938 | Goodhart | 602/16 |
| 2,456,277 | A | * | 12/1948 | Heitz-Boyer | 5/621 X |
| 2,535,559 | A | * | 12/1950 | Wolf | 5/630 |
| 2,642,250 | A | * | 6/1953 | Kasnowich | 248/229.1 |
| 2,693,987 | A | * | 11/1954 | Wall et al. | 5/621 X |
| 2,703,265 | A | * | 3/1955 | Wolfe | 248/214 |
| 2,735,738 | A | * | 2/1956 | Berne | 5/621 X |
| 2,749,196 | A | * | 6/1956 | Wolfe | 248/214 |
| 2,904,798 | A | * | 9/1959 | Heflin | 5/621 |
| 3,046,072 | A | * | 7/1962 | Douglass, Jr. et al. | 5/646 |
| 3,339,913 | A | * | 9/1967 | Anderson | 5/600 |
| 3,389,702 | A | * | 6/1968 | Kennedy | 606/119 |
| 3,875,356 | A | * | 4/1975 | Heim et al. | 200/52 R |
| 4,328,799 | A | * | 5/1982 | LoPiano | 604/23 |
| 4,381,572 | A | * | 5/1983 | Thumberger | 5/631 |
| 4,391,438 | A | * | 7/1983 | Heffington, Jr. | 5/630 |
| 4,526,355 | A | * | 7/1985 | Moore et al. | 5/624 |
| 4,547,092 | A | * | 10/1985 | Vetter et al. | 403/59 |
| 4,583,725 | A | * | 4/1986 | Arnold | 5/621 |
| 4,602,756 | A | * | 7/1986 | Chatfield | 248/223.41 |
| 4,624,245 | A | * | 11/1986 | Mullin et al. | 5/621 X |
| 4,672,952 | A | * | 6/1987 | Vrzalik | 5/621 X |
| 4,796,846 | A | * | 1/1989 | Meier et al. | 248/286.1 |
| 5,390,383 | A | * | 2/1995 | Carn | 5/621 X |
| 6,003,176 | A | * | 12/1999 | Wasley et al. | 5/621 X |
| 6,023,800 | A | * | 2/2000 | Stickley | 5/621 |
| 6,032,309 | A | * | 3/2000 | Michelson | 5/621 |
| 6,154,901 | A | * | 12/2000 | Carr | 5/621 |
| 6,298,507 | B1 | * | 10/2001 | Clyburn | 5/623 |
| 6,311,349 | B1 | * | 11/2001 | Kazakia et al. | 5/621 X |
| 6,315,260 | B1 | * | 11/2001 | Lees | 248/286.1 |

* cited by examiner

*Primary Examiner*—Robert G. Santos
(74) *Attorney, Agent, or Firm*—Adams & Wilks

(57) ABSTRACT

A body supporting tool for a bed includes a guide rail (3) releasably fixed to a frame (1) of the bed, a slide housing (6) guided by the guide rail (3), a turning support (11), and an abutment plate (19) moving forward and backward along the guide rail (3) together with the slide housing (6) and supporting a body of a person lying on the bed while abutting the body. When an operating handle (14) is turned in a set direction by a set angle, the slide housing (6) switches its states from a moving state to a fixing state, and when the handle (14) is turned in a direction opposite to the set direction by the set angle, the slide housing (6) switches its states from the fixing state to the moving state. As a result of this construction, a simply operable body supporting tool is provided, which can releasably be mounted on a bed easily and whose position can be adjusted conveniently, quickly, and reliably after mounted on the bed.

3 Claims, 6 Drawing Sheets

BODY SUPPORTING TOOL FOR BED

BACKGROUND OF THE INVENTION

1. Field of the Invention

The present invention relates to a body supporting tool for a bed, which is a position-adjustable tool releasably mountable on a bed for supporting a person lying on the bed reliably and comfortably while allowing the bed to tilt safely.

2. Description of the Related Art

In various facilities such as a hospital, a therapeutic institution or a rehabilitation center, a bed is sometimes tilted right and left repeatedly with a person laid thereon for giving medical treatment or rehabilitation training. In such a case, in order to prevent the person lying on the bed from rolling or sliding sideward over the tilted bed, a nurse or an attendant operates a body supporting tool for supporting the body of a person lying on a bed by fixing the tool to a frame of the bed in advance and setting up the tool so that the person will be held on the bed in an optimal condition.

When the body supporting tool is used in order to prevent the person from rolling or sliding sideward over the constantly inclining bed, even a nurse or an attendant who is unfamiliar with handling the tool is required to operate the tool so that the person's body can be supported on the bed optimally. However, it is not always easy for such nurse or attendant to handle the tool, and thus it entailed much time to operate the tool, and the person's body was not supported on the bed in a satisfactory position. For this reason, there has been a call for a body supporting tool which can be operated and handled easily even by an untrained nurse or attendant, which can hold a person on a bed comfortably and reliably, and which allows the bed to be tilted safely.

SUMMARY OF THE INVENTION

It is therefore an object of the present invention to provide a body supporting tool for a bed which can be releasably mounted on the bed easily and whose position can be adjusted conveniently after mounted on the bed, so that even a nurse or an attendant not so well trained in handling the tool can mount the tool on and dismount it from the bed quickly and reliably and can adjust its position quickly and reliably once the tool has been mounted on the bed, and hence the bed can be tilted safely while keeping a person laid thereon comfortably and reliably.

To achieve the above object, one aspect of the present invention provides a body supporting tool for a bed which comprises a guide rail releasably fixed to a frame of the bed, a slide housing movable relative to the guide rail while guided by the guide rail, a turning support turnably held by the slide housing at a base end portion thereof and having an operating member on an upper end portion thereof, a slide housing movement control mechanism provided within the slide housing for switching states of the slide housing between a slide housing moving state in which the slide housing is allowed to move relative to the guide rail and a slide housing fixing state in which the slide housing is not allowed to move relative to the guide rail, a support turning motion converting mechanism for causing the slide housing movement control mechanism to switch the states of the slide housing from the slide housing moving state to the slide housing fixing state when the turning support is turned in a set direction by a set angle, and from the slide housing fixing state to the slide housing moving state when the turning support is turned in a direction opposite to the set direction by the set angle, and an abutment plate swingably supported around the turning support by the turning support, moving forward and backward along the guide rail together with the slide housing when the slide housing moves forward and backward along the guide rail, and supporting a body of a person lying on the bed while abutting the body.

Preferably, the slide housing movement control mechanism includes fixed engaging members and movable engaging members engaging with the fixed engaging members, the fixed engaging members extend in a longitudinal direction of the guide rail integrally with the guide rail, and the movable engaging members are arranged within the slide housing in such a manner that the movable engaging members move along the guide rail together with the slide housing and are set in a slide housing moving position where movement of the slide housing is permitted as the movable engaging members evacuate from an engaging position where the movable engaging members are engageable with the fixed engaging members on the guide rail and in a slide housing fixing position where movement of the slide housing is prohibited as the movable engaging members engage with the fixed engaging members on the guide rail.

Preferably, the support turning motion converting mechanism has a cam mechanism at a base end portion of the turning support in a manner coupled to interlock with turning movement of the turning support, and the cam mechanism causes the slide housing movement control mechanism to switch the states from the slide housing moving state to the slide housing fixing state when the turning support is turned in a set direction by a set angle, and from the slide housing fixing state to the slide housing moving state when the turning support is turned in a direction opposite to the set direction by the set angle.

BRIEF DESCRIPTION OF THE DRAWINGS

The present invention will be described in further detail with reference to the accompanying drawings, in which.

DETAILED DESCRIPTION

Figure 1:
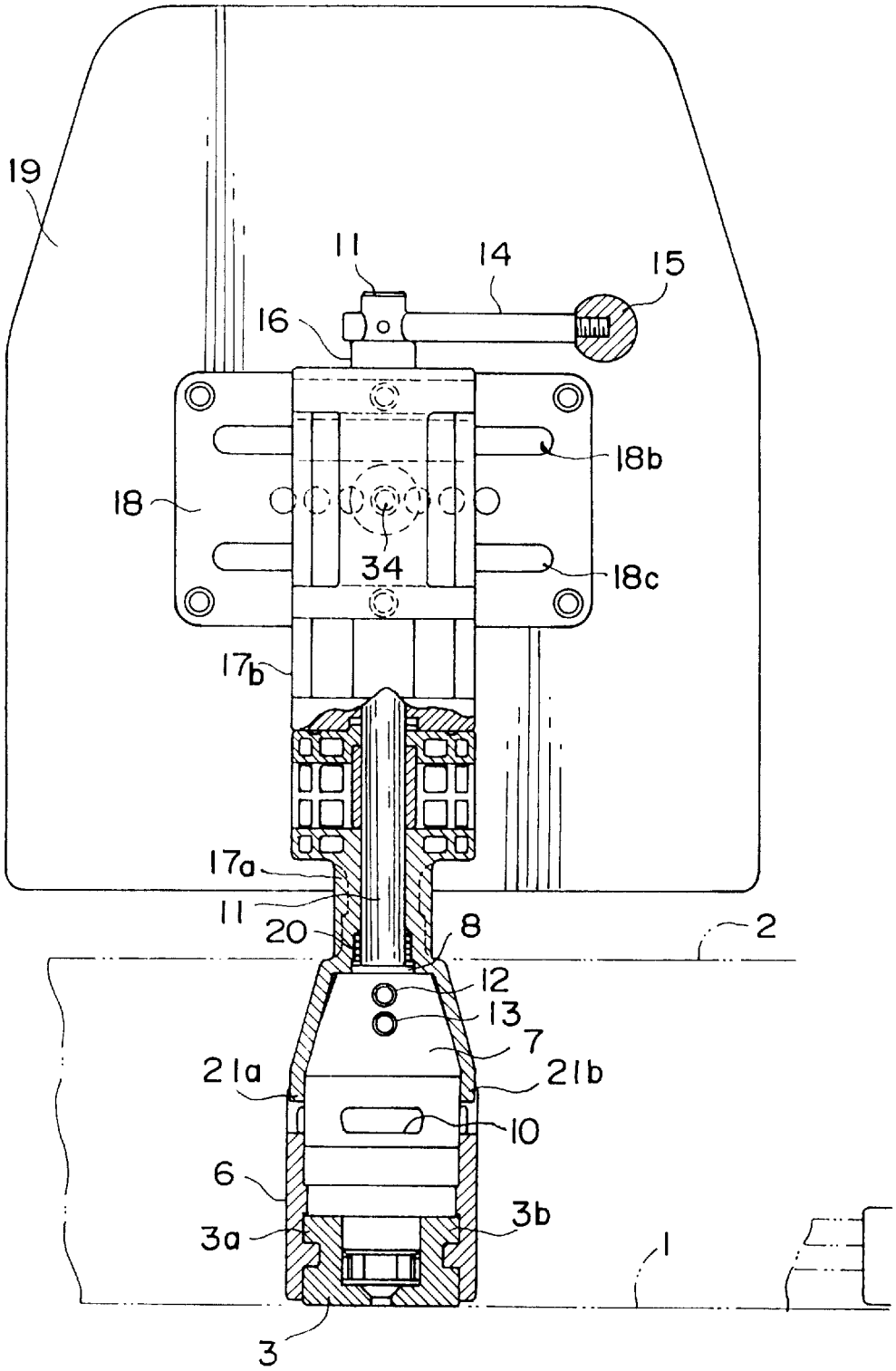
FIG. 1 is a longitudinally sectional rear view showing the main part of a body supporting tool for a bed, which is an embodiment of the present invention.
Figure 2:
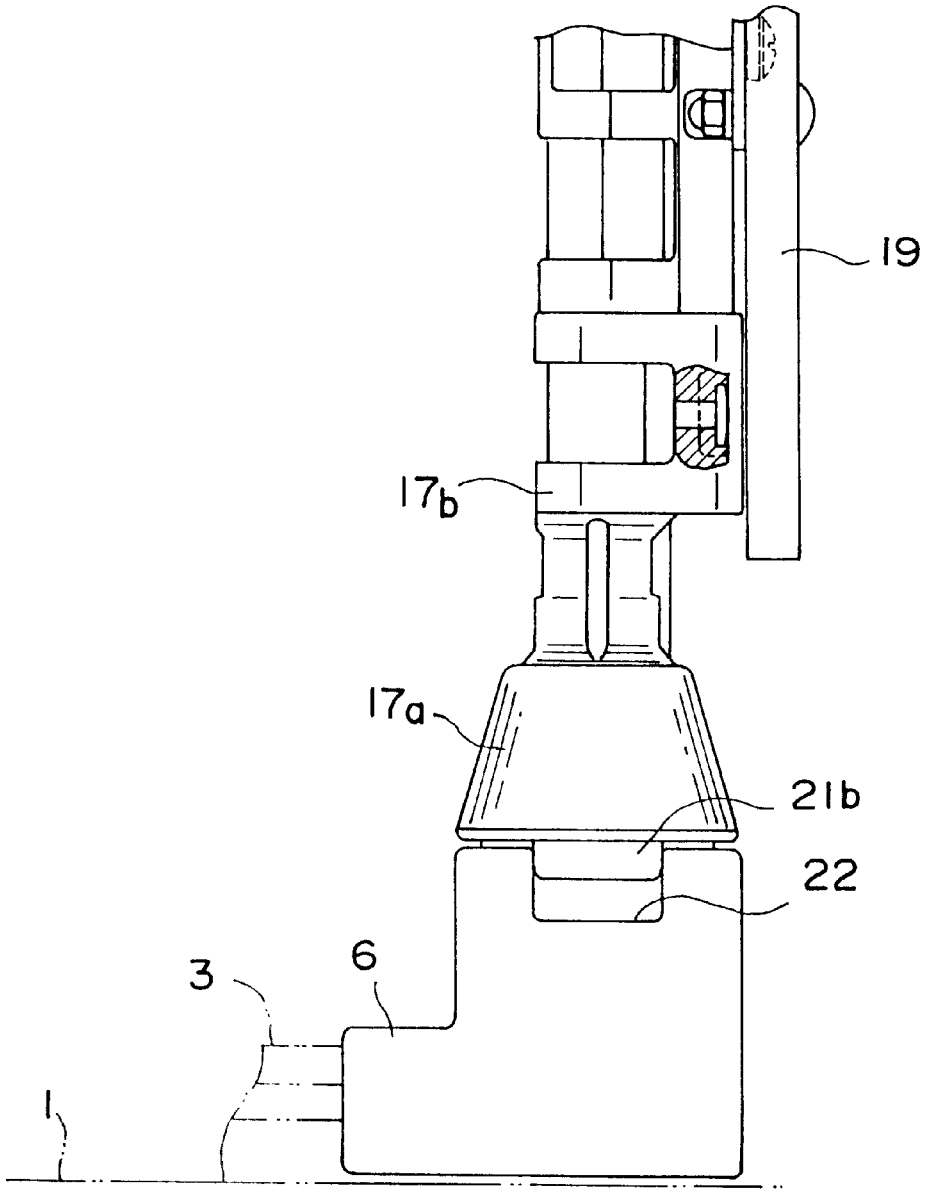
FIG. 2 is a side view of the same.
Figure 3:
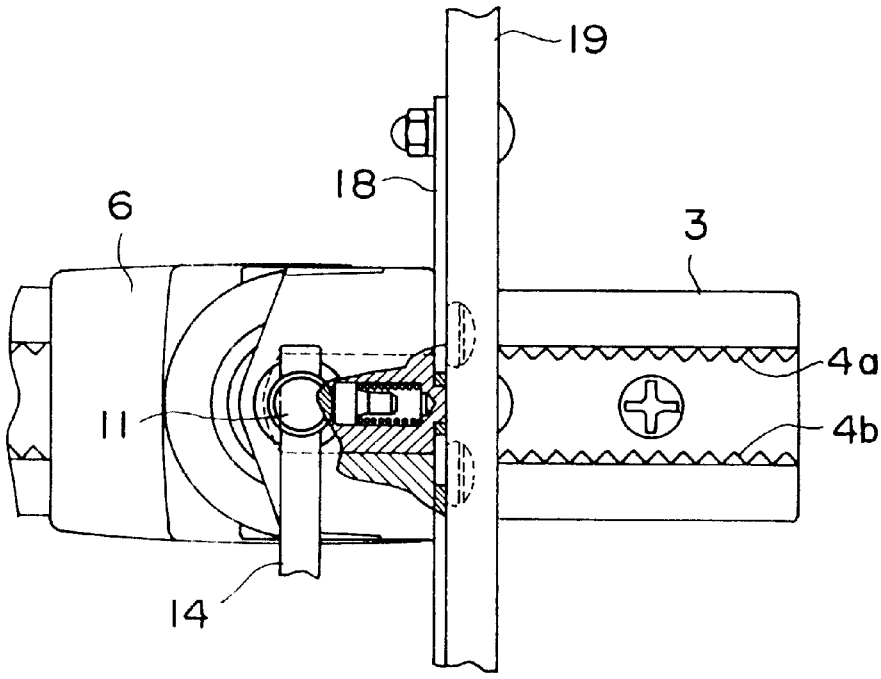
FIG. 3 is a plan view of the same.

Referring now to FIGS. 1 to 3, the tool illustrated is a body supporting tool for a bed, which is an embodiment of the present invention, with its main part viewed from its back, side, and top, respectively. The body supporting tool to be mounted on a bed includes a guide rail 3 releasably fixed by fixing means such as fixing screws to a frame 1 of the bed on which a mat 2 is spread. The rail 3 not only guides a moving part of the body supporting tool for adjusting the position of such moving part, but also reliably fixes the moving part to the frame 1 of the bed while the tool is in use.

To laterally support a person who is lying on the mat 2 using this tool, the guide rail 3 is positioned and fixed to frame members extending in a transverse direction of the bed or across the width of the bed in such a manner that its longitudinal direction coincides with the transverse direction of the bed. The mat 2 has a slit of a predetermined width formed in advance in and along the transversely extending frame members of the bed frame 1 along which the guide rail 3 extends. The slit allows the moving part of the body supporting tool to move across the bed while vertically passing through the mat 2 when the position of the moving part is to be adjusted along the guide rail 3 after the tool has been fixed in the above-mentioned way. Further, since a bed is usually symmetrical on both sides, slits each having a predetermined width such as mentioned above may be formed in the mat 2 symmetrically on both sides, so that two body supporting tools of the invention can be mounted on a bed symmetrically on both sides.

As shown in FIGS. 1 to 5, the guide rail 3 includes a pair of side wall portions 3*a* and 3*b*, and a bottom wall portion 3*c* integrally uniting the portions 3*a* and 3*b* along the base thereof. For example, as shown in FIG. 1, the guide rail 3 is detachably fixed to the bed frame 1 by fixing means such as fixing screws driven into holes which are formed in the bottom wall portion 3*c* at intervals along the length of the portion 3*c*.

In FIGS. 1 to 5, a fixed rack 4*a* extends integrally with the inner surface of the side wall portion 3*a* along the length of the guide rail 3, and so does a fixed rack 4*b* integrally with the inner surface of the side wall portion 3*b*. These fixed racks 4*a* and 4*b* may be integrally formed directly on the side wall portions 3*a* and 3*b*, or may be independent racks which are made of a wear-resistant material and integrally bonded to the inner surfaces of the side wall portions 3*a* and 3*b* of the guide rail 3, respectively. On the other hand, a guide groove 5*a* is formed in the outer surface of the side wall portion 3*a* along the length of the guide rail 3, and so is a guide groove 5*b* in the outer surface of the side wall portion 3*b*.

In FIGS. 1 to 5, a slide housing 6 engages with the guide rail 3 in a fashion standing astride the rail 3. Ridges 6*a* and 6*b* extend on the inner surfaces of skirts, i.e., both sides of the slide housing 6 along a direction in which the housing 6 moves, respectively. These ridges 6*a* and 6*b* are fitted into the corresponding guide grooves 5*a* and 5*b* of the guide rail 3 in such a manner that the former can move in sliding contact with the latter, or the former are freely slidable along the latter.

The slide housing 6 has a cylindrical upper portion. A cam driver 7 is fitted with this cylindrical upper portion of the housing 6 so that the driver 7 can turn about the longitudinal axis of a turning support 11 integrally with the support 11. The cam driver 7 and the base and portion of the turning support 11 are held together by caulking pins 12 and 13 in a manner integral with each other through a support receiving sleeve 8. The turning support 11 has at its upper end portion an operating member which is equipped with an operating handle 14 and a grip 15. Further, the slide housing 6 has a plurality, e.g., a pair, of circumferentially extending, diametrically opposed arcuate guide grooves 10 formed in its cylindrical upper portion. Engaging projections 9*a* and 9*b*, formed in the outer peripheral portion of the cam driver 7, engage with the arcuate guide grooves 10 corresponding thereto. The engagement of the projections 9*a* and 9*b* with the grooves 10 prevents the cam driver 7 from coming off from the slide housing 6, and at the same time, regulates an angular range within which the cam driver 7 is allowed to move relative to the slide housing 6.

In FIGS. 1 to 3 and FIGS. 6 and 7, an enclosing member 17*a* is fitted around the turning support 11 and the cam driver 7, covering an area extending from a lower portion of the support 11 to the outer surface of an upper portion of the driver 7 in a manner to allow the support 11 and the driver 7 to turn therein. The enclosing member 17*a* has at its lower edge a plurality, e.g., a pair, of circumferentially extending, diametrically opposed locking projections 21*a* and 21*b*. These projections 21*a* and 21*b* engage with corresponding notches 22 formed in an upper edge of the slide housing 6, respectively, thereby preventing the enclosing member 17*a* from turning relative to the slide housing 6.

The operating handle 14 having the grip 15 attached to its upper end portion is fixed at its base end portion to the upper end portion of the turning support 11 in a manner projecting in a radial direction from the support 11. An abutment plate support member 17*b* is fitted around the turning support 11 while extending from a larger diameter portion 16 of the support 11 which is immediately below the portion to which the operating handle 14 is fixed to an upper end of the enclosing member 17*a* in a manner turnable relative to the support 11 about the axis of the support 11. The abutment plate support member 17*b* supports an abutment plate 19 on the back through a mounting position adjusting plate 18 so that the position of the plate 19 can be adjusted in the transverse direction of the bed. A soft cushion material is normally attached to at least an abutment side of the abutment plate 19 so that the plate 19 can support a person who is lying on the mat 2 on the bed in comfortable and flexible abutment with the person's body.

Figure 6:
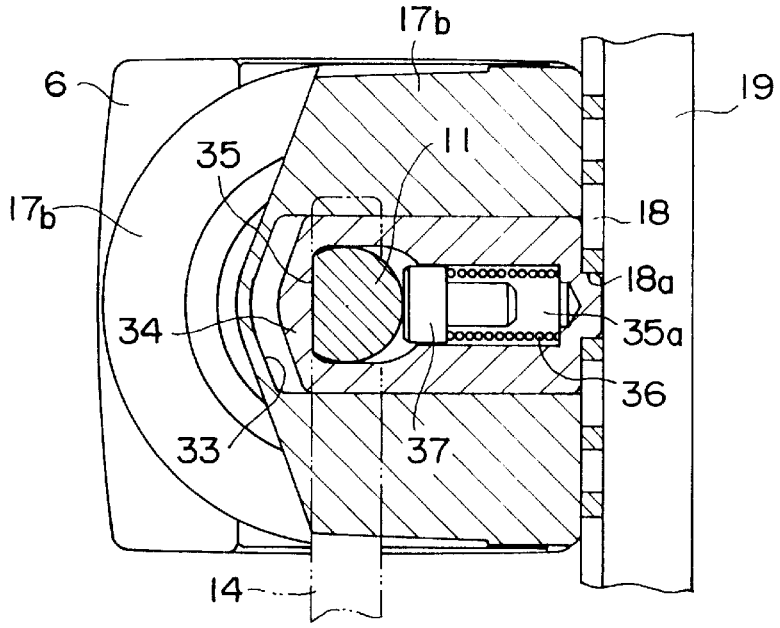
FIG. 6 is a horizontally sectional plan view of the same.
Figure 7:
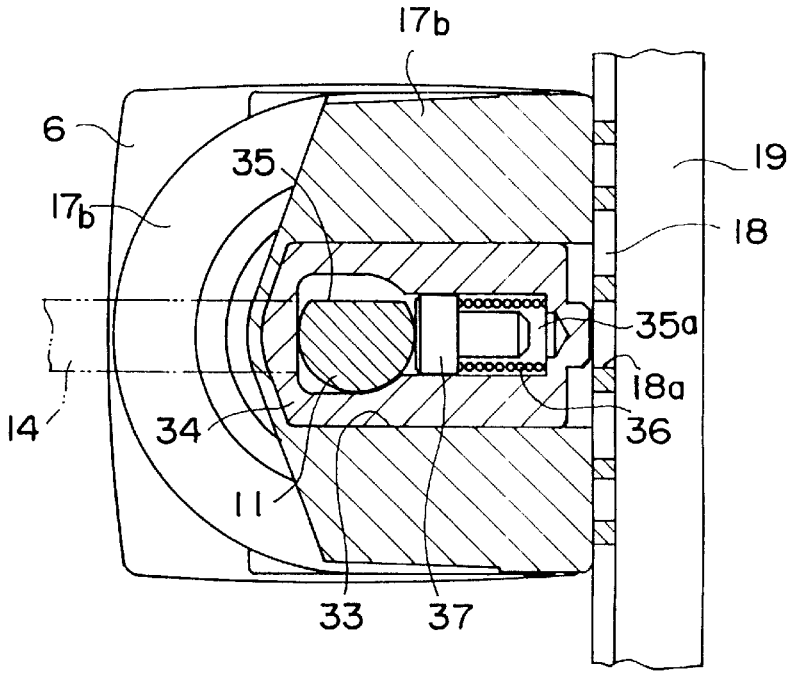
FIG. 7 is a horizontally sectional plan view of the same, which is in a different state from that in FIG. 6.

In FIGS. 6 and 7, the abutment plate support member 17*b* has a transverse guide hole 33 formed so as to extend in a direction perpendicular to the mounting position adjusting plate 18 and the abutment plate 19, and a sliding element 34 is fitted into the transverse guide hole 33 in a manner movable in sliding contact with the hole 33 along the longitudinal axis of the hole 33, i.e., in the direction perpendicular to the mounting position adjusting plate 18 and the abutment plate 19. The sliding element 34, which allows the turning support 11 to pass therethrough vertically and a resilient spring chamber 35*a* to be formed along the longitudinal axis of the transverse guide hole 33, serves as a member for positioning the abutment plate 19. A circumferential portion of the turning support 11 which confronts a side surface of the sliding element 34 by vertically passing through the element 34 is notched to form a flat surface 35.

The flat surface 35 is oriented, as shown in FIG. 6, toward the same direction as the back side of the mounting position adjusting plate 18 and the abutment plate 19 when the operating handle 14 is positioned in parallel with the plates 18 and 19, i.e., when the handle 14 is set in a direction perpendicular to the longitudinal direction of the guide rail 3. On the other hand, as shown in FIG. 7, when the operating handle 14 is turned 90° clockwise from the state shown in FIG. 6 to be set in the direction perpendicular to the plates 18 and 19, i.e., when the handle 14 is set in the longitudinal direction of the guide rail 3, the flat surface 35 is oriented toward a direction of one side of the plates 18 and 19.

As shown in FIGS. 6 and 7, a sliding contact member 37 is fitted into the resilient spring chamber 35*a* so that the member 37 is in contact with the circumferential surface of the turning support 11 at all times, and a resilient spring 36 is interposed between the sliding contact member 37 and end faces of the resilient spring chamber 35*a*. Therefore, when the operating handle 14 is set in parallel with the mounting position adjusting plate 18 and the abutment plate 19, i.e., in the direction perpendicular to the longitudinal direction of the guide rail 3 as shown in FIG. 6, the flat surface 35 of the turning support 11 contacts an end face of the resilient spring chamber 35*a*, thereby causing the positioning sliding element 34 to move closer to the plates 18 and 19. Then, as a projecting end portion of the element 34 engages with a selected one of a plurality of positioning holes 18*a* formed at intervals along the length of the mounting position adjusting plate 18 or in a longitudinal direction of the bed, the mounting position adjusting plate 18 and the abutment plate 19 are positioned with respect to the abutment plate supporting member 17*b* in the longitudinal direction of the bed.

In contrast, when the operating handle 14 is set, as shown in FIG. 7, in the direction perpendicular to the mounting position adjusting plate 18 and the abutment plate 19, i.e., in the longitudinal direction of the guide rail 3, the flat surface 35 of the turning support 11 moves away from the end face of the resilient spring chamber 35*a*, and as a result, the positioning sliding element 34 moves away from the plates 18 and 19 against the resiliency of the resilient spring 36, which in turn causes the projecting end portion of the element 34 to disengage from the positioning hole 18*a* formed in the plate 18, whereby the mounting position adjusting plate 18 and the abutment plate 19 are ready to be positioned again with respect to the abutment plate supporting member 17*b* in the longitudinal direction of the bed.

To perform the repositioning of the mounting position adjusting plate 18 and the abutment plate 19 with respect to the abutment plate supporting member 17*b* smoothly, rails 18*b* and 18*c* may be formed on the back side of the mounting position adjusting plate 18 in a manner extending along the length of the plate 18, and these rails 18*b* and 18*c* may be engaged with rail engaging members provided on the abutment plate supporting member 17*b*. This arrangement would facilitate movements of the mounting position adjusting plate 18 relative to the abutment plate supporting member 17*b* along the length of the plate 18.

Figure 4:
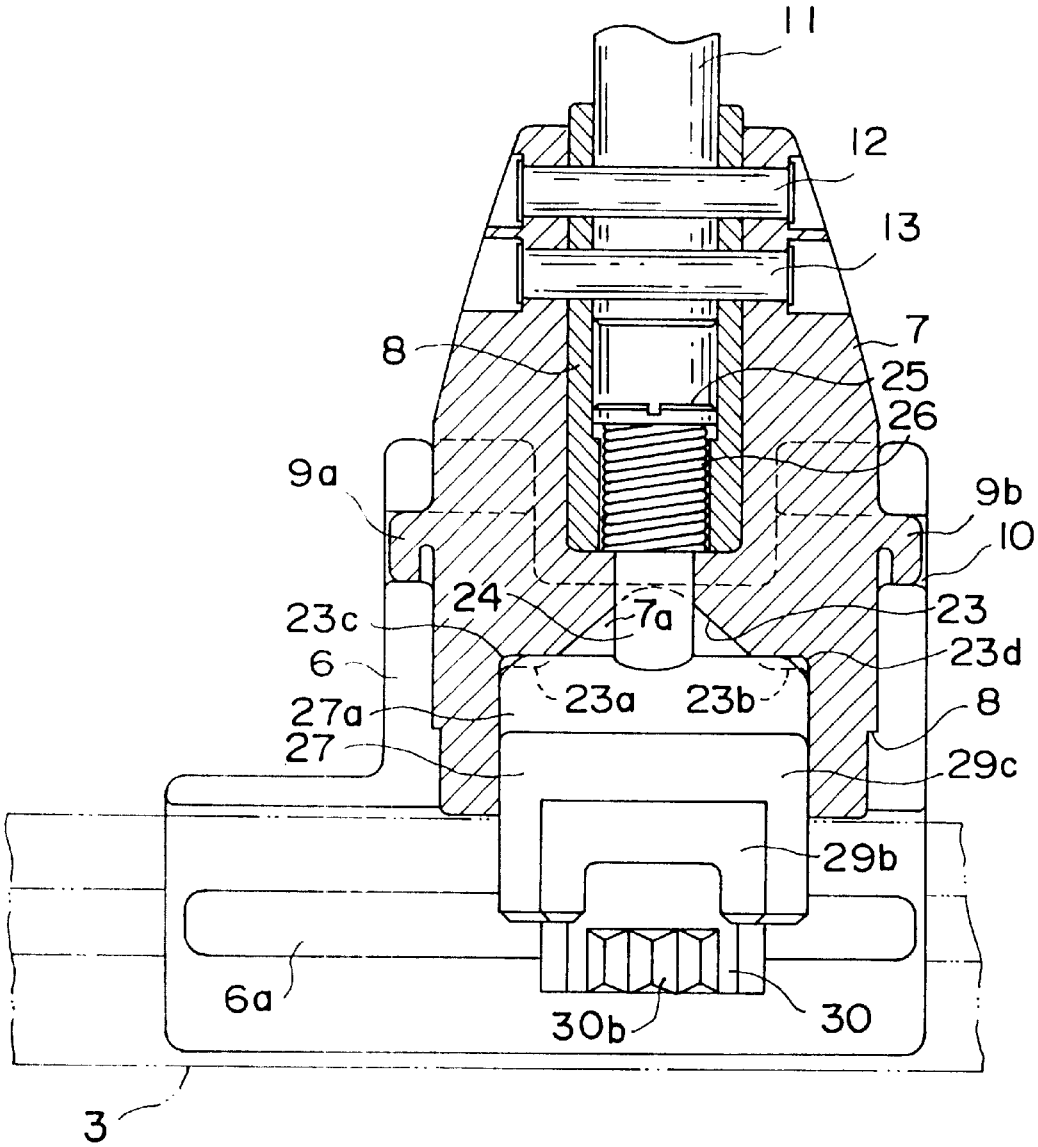
FIG. 4 is an enlarged longitudinally sectional side view of the same taken along a line A—A in FIG. 5.
Figure 5:
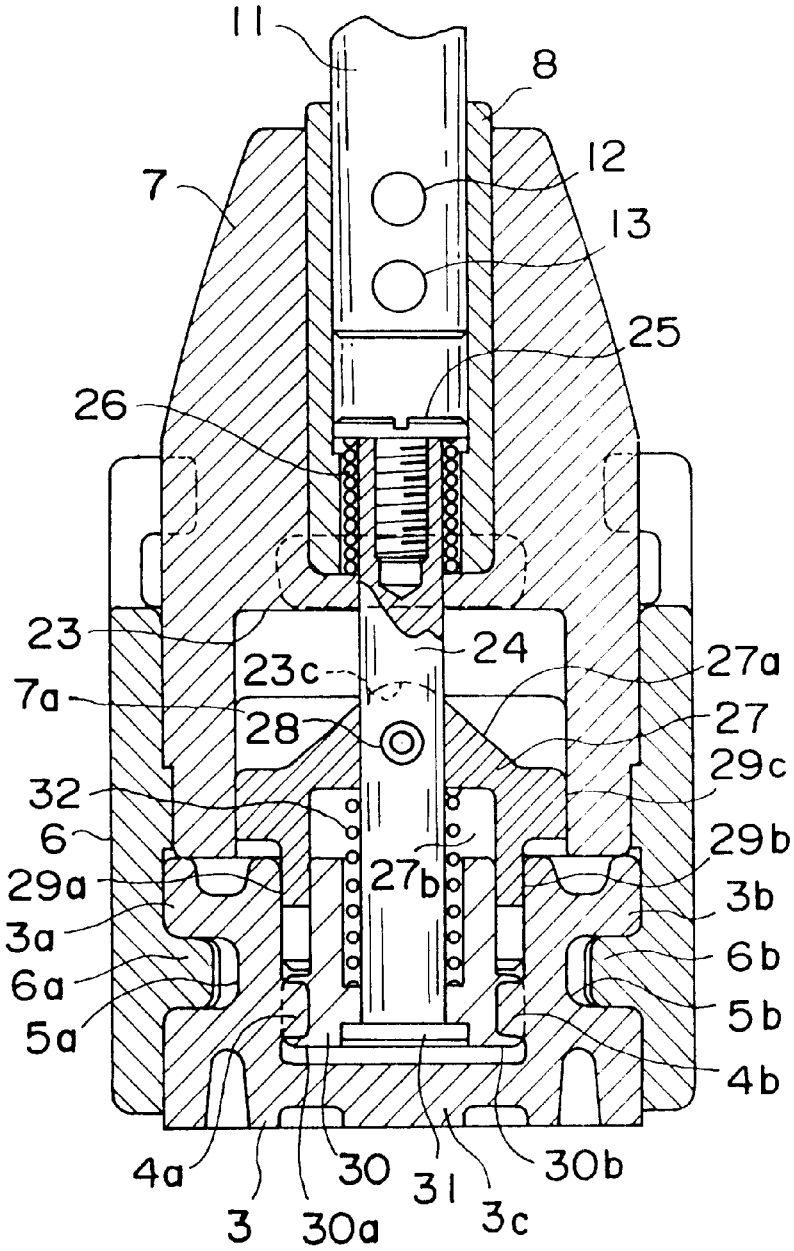
FIG. 5 is an enlarged longitudinally sectional rear view of the same.

In FIGS. 4 and 5, a cam chamber 7*a* is formed in a central portion of the cam driver 7. The chamber 7*a* is a bottomless cylindrical portion which is circular in horizontal cross section having an inner circumferential wall surface and an inner ceiling wall surface. In the inner ceiling wall surface of the chamber 7*a*, a diametrically extending recess 23 and flat portions 23*a* and 23*b* flaking the recess 23 are formed. Further, shallow grooves 23*c* and 23*d* are formed in the flat portions 23*a* and 23*b* in a manner extending in a direction orthogonal to the longitudinal axis of the cam chamber 7*a* and perpendicular to the diametrically extending recess 23, respectively. The recess 23 and the flat portions 23*a* and 23*b* are continuous through smooth curved surfaces, thereby forming a driving cam surface in cooperation with one another.

As shown in FIGS. 4 and 5, a cam follower 27 is fitted into the cam chamber 7*a*. The cam follower 27 has a cylindrical surface 29*c* movable in both circumferential and axial directions in sliding contact with the inner circumferential wall surface of the cam chamber 7*a*. The cam follower 27 has mutually parallel, diametrically opposed smoothed surfaces 29*a* and 29*b* formed by notching a lower portion of its outer circumferential wall surface. The cam follower 27 is fitted at its lower portion between the side wall portions 3*a* and 3*b* of the guide rail 3 in a manner such that these smoothed surfaces 29*a* and 29*b* come in sliding contact with the inner surfaces of the walls 3*a* and 3*b* corresponding thereto, respectively. Therefore, even when the cam driver 7 is turned by the turning support 11 about the axis of the support 11, the side wall portions 3*a* and 3*b* of the guide rail 3 block the turning of the cam follower 27, and thus the cam follower 27 never turns with respect to the guide rail 3.

In FIGS. 4 and 5, the cam follower 27 has on its top a ridge 27*a* which extends along the length of the guide rail 3. Further, the cam follower 27 has a movable rack member holding chamber 27*b* in a central portion thereof. The chamber 27*b* is a bottomless cylindrical portion having an inner circumferential wall surface and an inner ceiling wall surface, and holds both a movable rack member 30 on its inner circumferential wall surface in a manner to allow the member 30 to move up and down, and a movable rack biasing spring 32 for biasing the movable rack member 30 downward.

As shown also in FIGS. 4 and 5, a cam follower shaft 24 passes through both the recess 23 of the cam driver 7 and the cam follower 27 along the axis of the turning support 11 and the cam driver 7. The cam follower shaft 24 projects upward into the support receiving sleeve 8, where a spring shoe screw 25 is driven into the top end portion of the shaft 24. Between the head of the spring shoe screw 25 and a transverse wall portion of the cam driver 7 through which the cam follower shaft 24 passes is a cam biasing spring 26, which is a compression spring.

The cam follower shaft 24 is supported on the cam follower 27 by a cam support pin 28. The pin 28 passes through a middle portion of the shaft 24 and an upper wall portion of the cam follower 27 in the longitudinal direction of the guide rail 3. Since the cam follower shaft 24 is biased upward toward the cam driver 7 by the cam biasing spring 26 at all times, the cam follower 27 which is supported on the cam follower shaft 24 is also biased upward toward the cam driver 7 at all times. Therefore, a driven cam surface formed by the ridge 27*a* of the cam follower 27 is in contact with the driving cam surface formed continuously by the recess 23 and the flat portions 23*a* and 23*b* at all times. Hence, in accordance with the turning angle of the turning support 11 and the cam driver 7, the ridge 27*a* gets fitted into the recess 23 to cause the cam follower shaft 24 to move upward, or the ridge 27*a* runs up onto the flat portions 23*a* and 23*b* to cause the cam follower shaft 24 to move downward.

As further shown in FIGS. 4 and 5, within the movable rack member holding chamber 27*b* of the cam follower 27, the movable rack member 30 engages with the follower 27 in a position further below than the cam support pin 28 inserted into the cam follower shaft 24. The member 30 is movable in sliding contact with the follower 27 only vertically. A flange 31 is formed on the bottom end portion of the cam follower shaft 24 for preventing the movable rack member 30 from coming off, and a movable rack biasing spring 32 is interposed between the cam follower 27 and the movable rack member 30. The spring 32 is a compression spring. The movable rack member 30 is biased toward the flange 31 of the cam follower shaft 24 at all times by the resiliency of the movable rack biasing spring 32.

In FIGS. 4 and 5, the movable rack member 30 has parallelly extending, diametrically opposed notched smoothed surfaces formed on its outer circumferential wall surface. These smoothed surfaces on the outer circumferential wall surface of the member 30 are in sliding contact with inner circumferential wall surface portions of the movable rack member holding chamber 27*b* which correspond to these smoothed surfaces and which extend in parallel with the smoothed surfaces 29*a* and 29*b* on the outer circumferential wall surface of the cam follower 27. As a result, the movable rack member 30 slidably moves only vertically relative to the cam follower 27 within the movable rack member holding chamber 27*b* of the cam follower 27, without making circumferential motion relative to the follower 27, as mentioned above.

Still further, as shown in FIGS. 4 and 5, diametrically opposed movable racks 30*a* and 30*b* are formed on an outer circumferential surface portion at the bottom of the movable rack member 30. The racks 30*a* and 30*b* are engageable with the fixed racks 4*a* and 4*b* corresponding thereto which are formed on the inner surfaces of the side wall portions 3*a* and 3*b* of the guide rail 3.

The body supporting tool has the above-mentioned construction. Thus, when the operating handle 14 is turned to extend in the direction perpendicular to the longitudinal direction of the guide rail 3 as shown in FIGS. 3 and 6, the turning support 11 and the cam driver 7 turn to the state shown in FIGS. 4 and 5, so that the ridge 27*a* of the cam follower 27 is pushed down in a manner running up onto the flat portions 23*a* and 23*b* to be engaged with the shallow grooves 23*c* and 23*d*. In association therewith, the cam follower shaft 24 and the cam follower 27 move downward, and when the movable rack member 30 is resiliently biased downward by the movable rack biasing spring 32, the movable racks 30*a* and 30*b* mesh with the corresponding fixed racks 4*a* and 4*b* of the guide rail 3, whereby the abutment plate 19 is reliably held in position in a manner not movable relative to the guide rail 3.

On the other hand, when the operating handle 14 is turned to extend in the same direction as the longitudinal direction of the guide rail 3 as shown in FIG. 7, the turning support 11 and the cam driver 7 turn 90° from the state shown in FIGS. 4 and 5, so that the ridge 27*a* of the cam follower 27 is caused to be fitted into the recess 23 of the cam driver 7. In association therewith, the cam follower shaft 24 and the cam follower 27 move upward, and when the movable rack member 30 is elevated by the flange 31 of the cam follower shaft 24, the movable racks 30*a* and 30*b* disengage from the corresponding fixed racks 4*a* and 4*b* of the guide rail 3, whereby the abutment plate 19 becomes ready to move freely in the longitudinal direction of the guide rail 3 relative to the guide rail 3.

That is, in the body supporting tool for a bed shown in FIGS. 1 to 7, a mechanism for converting turning motion of the turning support 11 into vertical movement of the movable rack member 30 has a cam mechanism which is coupled to the base end portion of the turning support 11 in a manner to interlock with the turning of the support 11. The cam mechanism includes the recess 23 and the flat portions 23*a* and 23*b* of the cam driver 7. When the operating handle 14 is turned so that it extends in the direction perpendicular to the longitudinal direction of the guide rail 3 and the turning support 11 thereby turns in a set direction by a set angle, a slide housing control mechanism including the movable racks 30*a* and 30*b* of the movable rack member 30 and the fixed racks 4*a* and 4*b* of the guide rail 3 switches its states from a slide housing moving state to a slide housing fixing state. Further, when the operating handle 14 is turned so that it extends in the same direction as the longitudinal direction of the guide rail 3 and the turning support 11 thereby turns in a direction opposite to the set direction by the set angle, the slide housing control mechanism switches its states from the slide housing fixing state to the slide housing moving state.

In the body supporting tool for a bed shown in FIGS. 1 to 7, the slide housing control mechanism has fixed engaging members such as the fixed racks 4*a* and 4*b* and movable engaging members engaging with the fixed engaging members such as the movable racks 30*a* and 30*b*. The fixed engaging members extend along the length of the guide rail 3 integrally with the guide rail 3. The movable engaging members move along the guide rail 3 together with the slide housing 6 within the slide housing 6, and can be set in both a slide housing moving position and a slide housing fixing position. The former is a position where the slide housing 6 is permitted to move while evacuating from an engaging position at which the movable engaging members can engage with the fixed engaging members on the guide rail 3, and the latter is a position where the slide housing 6 is not allowed to move as a result of the movable engaging members engaging with the fixed engaging members on the guide rail 3.

The body supporting tool for a bed shown in FIGS. 1 to 7 is a preferred embodiment of the present invention, which is merely exemplary in nature and various modifications of the invention are thus possible. It is therefore to be understood that within the scope of the appended claims, the invention may be practiced otherwise than as specifically described.

According to the body supporting tool for a bed of the present invention, the following advantages can be obtained.

(1) The body supporting tool for a bed includes a guide rail releasably fixed to a frame of the bed, a slide housing movable relative to the guide rail while guided by the guide rail, a turning support turnably held by the slide housing at a base end portion thereof and having an operating member on an upper end portion thereof, a slide housing movement control mechanism provided within the slide housing for switching states of the slide housing between a slide housing moving state in which the slide housing is allowed to move relative to the guide rail and a slide housing fixing state in which the slide housing is not allowed to move relative to the guide rail, a support turning motion converting mechanism for causing the slide housing movement control mechanism to switch the states of the slide housing from the slide housing moving state to the slide housing fixing state when the turning support is turned in a set direction by a set angle, and from the slide housing fixing state to the slide housing moving state when the turning support is turned in a direction opposite to the set direction by the set angle, and an abutment plate swingably supported around the turning support by the turning support, moving forward and backward along the guide rail together with the slide housing when the slide housing moves forward and backward along the guide rail, and supporting a body of a person lying on the bed while abutting the body.

According to the above construction, the body supporting tool can be mounted on and dismounted from the bed easily, and its position can be adjusted conveniently and easily after mounted on the bed. Thus, even a nurse or an attendant not so well trained in handling the tool can releasably mount the tool on the bed quickly and reliably and can adjust its position quickly and reliably after having mounted the tool on the bed, and hence the bed can be tilted safely while keeping a person laid thereon comfortably and reliably.

(2) In the body supporting tool for a bed, the slide housing movement control mechanism includes fixed engaging members and movable engaging members engaging with the fixed engaging members. The fixed engaging members extend in a longitudinal direction of the guide rail integrally with the guide rail. Further, the movable engaging members are arranged within the slide housing in such a manner that the movable engaging members move along the guide rail together with the fixed engaging members on the guide rail and are set in a slide housing moving position where movement of the slide housing is permitted as the movable engaging members evacuate from an engaging position where the movable engaging members are engageable with the fixed engaging members on the guide rail and in a slide housing fixing position where movement of the slide housing is prohibited as the movable engaging members engage with the fixed engaging members on the guide rail.

According to the above construction, a simply structured mechanism comprised of the fixed engaging members and the movable engaging members can be used. Since this mechanism allows the slide housing to be locked by merely engaging the movable engaging members with the fixed engaging members and allows it to be moved by merely disengaging the movable engaging members from the fixed engaging members, the body supporting tool can be mounted on and dismounted from the bed easily, and its position can be adjusted conveniently and easily after mounted on the bed. Thus, even a nurse or an attendant not so well trained in handling the tool can releasably mount the tool on the bed quickly and reliably and can adjust its position quickly and reliably after having mounted the tool on the bed, and hence the bed can be tilted safely while keeping a person laid thereon comfortably and reliably.

(3) In the body supporting tool for a bed, the support turning motion converting mechanism has a cam mechanism at a base end portion of the turning support in a manner coupled to interlock with turning movement of the turning support, and the cam mechanism causes the slide housing movement control mechanism to switch the states from the slide housing moving state to the slide housing fixing state when the turning support is turned in a set direction by a set angle, and from the slide housing fixing state to the slide housing moving state when the turning support is turned in a direction opposite to the set direction by the set angle.

According to the above construction, a simply structured cam mechanism can be used. Since this cam mechanism allows the slide housing movement control mechanism to switch its states from the slide housing moving state to the slide housing fixing state reliably, the body supporting tool can be mounted on and dismounted from the bed easily, and its position can be adjusted conveniently and easily after mounted on the bed. Thus, even a nurse or an attendant not so well trained in handling the tool can releasably mount the tool on the bed quickly and reliably and can adjust its position quickly and reliably after having mounted the tool on the bed, and hence the bed can be tilted safely while keeping a person laid thereon comfortably and reliably.

What is claimed is:

1. A body supporting tool for a bed comprising:

a guide rail releasably fixed to a frame of said bed;

a slide housing movable relative to said guide rail while guided by said guide rail;

a turning support turnably held by said slide housing at a base end portion thereof and having an operating member on an upper end portion thereof;

a slide housing movement control mechanism provided within said slide housing for switching states of said slide housing between a slide housing moving state in which said slide housing is allowed to move relative to said guide rail and a slide housing fixing state in which said slide housing is not allowed to move relative to said guide rail;

a support turning motion converting mechanism for causing said slide housing movement control mechanism to switch said states of said slide housing from said slide housing moving state to said slide housing fixing state when said turning support is turned in a set direction by a set angle, and from said slide housing fixing state to said slide housing moving state when said turning support is turned in a direction opposite to said set direction by said set angle; and an abutment plate swingably supported around said turning support by said turning support, moving forward and backward along said guide rail together with said slide housing when said slide housing moves forward and backward along said guide rail, and supporting a body of a person lying on said bed while abutting said body.

2. A body supporting tool for a bed according to claim 1, wherein said slide housing movement control mechanism includes fixed engaging members and movable engaging members engaging with said fixed engaging members;

said fixed engaging members extend in a longitudinal direction of said guide rail integrally with said guide rail; and said movable engaging members are arranged within said slide housing in such a manner that said movable engaging members move along said guide rail together with said fixed engaging members on said guide rail and are set in a slide housing moving position where movement of said slide housing is permitted as said movable engaging members evacuate from an engaging position where said movable engaging members are engageable with said fixed engaging members on said guide rail and in a slide housing fixing position where movement of said slide housing is prohibited as said movable engaging members engage with said fixed engaging members on said guide rail.

3. A body supporting tool for a bed according to claim 1 or 2, wherein said support turning motion converting mechanism has a cam mechanism at a base end portion of said turning support in a manner coupled to interlock with turning movement of said turning support, and said cam mechanism causes said slide housing movement control mechanism to switch said states from said slide housing moving state to said slide housing fixing state when said turning support is turned in a set direction by a set angle, and from said slide housing fixing state to said slide housing moving state when said turning support is turned in a direction opposite to said set direction by said set angle.

* * * * *